US007589686B2

(12) United States Patent
Balzovsky et al.

(10) Patent No.: US 7,589,686 B2
(45) Date of Patent: Sep. 15, 2009

(54) SMALL ULTRA WIDEBAND ANTENNA HAVING UNIDIRECTIONAL RADIATION PATTERN

(75) Inventors: Evgeny V. Balzovsky, Tomsk (RU); Yuri I. Buyanov, Tomsk (RU); Yong-jin Kim, Seoul (KR); Vladimir I. Koshelev, Tomsk (RU); Do-Hoon Kwon, Seoul (KR); Seong-soo Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 414 days.

(21) Appl. No.: 11/334,567

(22) Filed: Jan. 19, 2006

(65) Prior Publication Data

US 2007/0257851 A1 Nov. 8, 2007

(30) Foreign Application Priority Data

Jan. 19, 2005 (KR) ..... 10-2005-0005078
Oct. 26, 2005 (KR) ..... 10-2005-0101159

(51) Int. Cl.
*H01Q 21/00* (2006.01)

(52) U.S. Cl. ..... 343/726; 343/767

(58) Field of Classification Search ..... 343/725, 343/726, 767

See application file for complete search history.

(56) References Cited

U.S. PATENT DOCUMENTS

| | | | | |
|---|---|---|---|---|
| 5,198,826 | A * | 3/1993 | Ito | 343/726 |
| 5,519,408 | A | 5/1996 | Schnetzer et al. | |
| 5,719,586 | A * | 2/1998 | Tuttle | 343/726 |
| 6,437,750 | B1 | 8/2002 | Grimes et al. | |
| 2003/0080911 | A1 | 5/2003 | Schuneman et al. | |
| 2007/0126648 | A1 * | 6/2007 | Svensson et al. | 343/767 |

FOREIGN PATENT DOCUMENTS

| | | |
|---|---|---|
| EP | 1 564 842 A | 8/2005 |
| GB | 2 281 662 A | 3/1995 |
| JP | 9-246849 A | 9/1997 |

* cited by examiner

*Primary Examiner*—Trinh V Dinh
*Assistant Examiner*—Dieu Hien T Duong
(74) *Attorney, Agent, or Firm*—Sughrue Mion, PLLC

(57) ABSTRACT

A small ultra wideband (UWB) antenna designed to have a unidirectional radiation pattern is disclosed. The UWB antenna includes a substrate; a power feeding part, provided on an upper surface of the substrate, for receiving a supply of an external electromagnetic energy; a dipole radiator excited by the electromagnetic energy fed through the power feeding part and radiating electromagnetic waves in one and the other directions of the substrate; and an active loop radiator excited by the electromagnetic energy fed through the power feeding part, respectively enhancing and canceling the electromagnetic fields produced in one or the other directions of the substrate by the dipole radiator.

1 Claim, 10 Drawing Sheets

SMALL ULTRA WIDEBAND ANTENNA HAVING UNIDIRECTIONAL RADIATION PATTERN

This application claims priority, under 35 U.S.C. § 119(a), from Korean Patent Application Nos. 10-2005-0005078 filed Jan. 19, 2005 and 10-2005-0101159 filed on Oct. 26, 2005 in the Korean Intellectual Property Office, the entire contents of which are incorporated herein by reference.

BACKGROUND OF THE INVENTION

1. Field of the Invention

Apparatuses consistent with the present invention relate to a small ultra wideband (UWB) antenna, and more particularly to a small UWB antenna designed to have a unidirectional radiation pattern by combining a loop radiator and a dipole radiator.

2. Description of the Related Art

All antennas are used to convert an electric signal into a specified electromagnetic wave to radiate the converted electromagnetic wave to free space, or to convert a received electromagnetic wave into an electric signal. UWB technology means a wireless transmission technology that directly transmits and receives an impulse signal without using an RF carrier. A UWB antenna is an antenna that can transmit and receive an impulse signal using a frequency band in the range of 3.1 to 10.6 GHz.

This UWB technology refers to a communication method that can achieve a high-speed data transmission using an ultra low power as it uses a very wide frequency band, unlike the existing narrow-band communication method. Accordingly, it can be applied to portable communication appliances that have been rapidly developed.

An antenna having been used in currently developed portable communication devices is required to satisfy the following conditions: being capable of performing UWB signal transmission/reception, having unidirectional radiation pattern, and being subminiature. The radiation pattern means the shape of an effective region where an antenna can radiate or sense electromagnetic waves. Since communication is possible in the case where the radiation pattern is formed in the direction of a base station, a portable communication appliance requires a unidirectional radiation pattern.

FIG. 1 is a view illustrating the structure of a Vivaldi antenna known in the art. Referring to FIG. 1, the antenna includes a power feeding part 11, an excitation part 12, a slot 13, a dipole radiator 14, and a substrate 15 that supports the above-mentioned components. The structure of such a Vivaldi antenna is disclosed in U.S. Pat. No. 5,428,364. When an external electromagnetic energy is supplied through the power feeding part 11, the excitation part 12 is excited. Accordingly, the electromagnetic energy transmitted along the power feeding part 11 is transferred to the slot 13 the width of which is gradually widened. The transferred electromagnetic energy is converted into an electromagnetic wave in the air at a right end part of the slot 13, and the electromagnetic wave is radiated in one direction as indicated by an arrow in FIG. 1.

This Vivaldi antenna can perform UWB signal transmission/reception and has a unidirectional radiation pattern. However, it requires an impedance matching in order to secure the radiation characteristic of the desired whole frequency band and to transmit electromagnetic energy provided from an external source without loss. In order to achieve the impedance matching, the size of the antenna should be increased as the wavelength of the wave is lengthened.

Consequently, in order to perform a low frequency band communication, the size of the antenna should be increased, and this causes a difficulty in miniaturization of the communication appliance.

FIG. 2 is a view illustrating the structure of a substrate type dipole antenna. Referring to FIG. 2, the substrate type dipole antenna includes a substrate 21, a first radiator 22, second radiators 23*a* and 23*b*, a feeder 24, and a signal supply part 25. The antenna structure of FIG. 2 is disclosed in U.S. Pat. No. 6,642,903, the detailed explanation thereof will be omitted.

In the substrate type dipole antenna of FIG. 2, the first radiator 22 and the second radiators 23*a* and 23*b*, which are prepared as wide plane conductors, are laminated on the substrate 21 to implement a wideband antenna. The electromagnetic energy supplied from the signal supply part 25 is applied to the feeder 24. The feeder 24 and separations 26*a* and 26*b* formed on the right and left of the feeder 24 constitute a feed region 30. The fed electromagnetic energy is converted into electromagnetic waves by the first radiator 22 and the second radiators 23*a* and 23*b*, and the converted electromagnetic waves are radiated in the direction of an arrow. This substrate type dipole antenna has the advantage in that it can transmit a UWB signal and can be fabricated with a relatively small size, but has the problem that it cannot have a unidirectional radiation pattern.

In addition to the Vivaldi antenna and the substrate type dipole antenna as described above, "Microstrip Patch Antenna," by Weigand et al, IEEE Trans. Antennas Propagat. vol. 51, no. 3, March 2003, is known. Although this microstrip patch antenna has unidirectional radiation pattern and can be subminiaturized, it has the problem that it has a narrow bandwidth.

SUMMARY OF THE INVENTION

Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above. An aspect of the present invention is to provide a small UWB antenna designed to have a unidirectional radiation pattern by using a loop radiator and a dipole radiator.

In order to achieve the above-described aspects of the present invention, there is provided a UWB antenna, according to an exemplary embodiment of the present invention, which comprises a substrate, a power feeding part, provided on an upper surface of the substrate, for receiving a supply of an external electromagnetic energy; a dipole radiator excited by the electromagnetic energy fed through the power feeding part and radiating electromagnetic waves in one and the other directions of the substrate; and an active loop radiator excited by the electromagnetic energy fed through the power feeding part, respectively enhancing and canceling the electromagnetic fields produced in one or the other directions of the substrate by the dipole radiator.

The UWB antenna may further comprise a delay part, provided to connect the power feeding part with the dipole radiator on the upper surface of the substrate, for delaying a time point where the electromagnetic energy is supplied to the dipole radiator.

The UWB antenna may further comprises at least one passive loop radiator excited by an induced electromagnetic energy induced by the dipole radiator and the active loop radiator, respectively enhancing and canceling the electromagnetic fields produced in one or the other directions of the substrate by the dipole radiator.

The active loop radiator, the dipole radiator, the delay part and the passive loop radiator may be positioned on the same plane as the power feeding part on the upper surface of the substrate.

In this case, the power feeding part, the active loop radiator, the dipole radiator, the delay part and the passive loop radiator may be produced by patterning a single metal film deposited on the upper surface of the substrate.

The power feeding part may comprise a signal terminal, provided on the upper surface of the substrate, for receiving the supply of the electromagnetic energy, and first and second ground terminals arranged on both sides of the signal terminal to form a coplanar waveguide structure on the upper surface of the substrate.

The active loop radiator has one end connected to the signal terminal and the other end connected to the first ground terminal.

The dipole radiator may comprise a first pole arranged on the upper surface of the substrate to slope at a predetermined angle to one side of the substrate, and a second pole arranged on the upper surface of the substrate to slop at a predetermined angle to the first pole.

The dipole radiator may have a structure in which the first pole is connected to the signal terminal and the second pole is connected to the second ground terminal.

In another aspect of the present invention, there is provided a UWB antenna, which comprises a substrate; a power feeding part, provided on an upper surface of the substrate, for receiving a supply of an electromagnetic energy; a dipole radiator excited by the electromagnetic energy fed through the power feeding part and radiating electromagnetic waves in specified directions; and a loop radiator for making the electromagnetic waves radiated by the dipole radiator have a unidirectional radiation pattern by interfering the electromagnetic waves.

The power feeding part may include a signal terminal, provided on the upper surface of the substrate, for receiving the supply of the electromagnetic energy, a first ground terminal arranged apart for a specified distance from the signal terminal on the upper surface of the substrate, and a second ground terminal, arranged in a direction opposite to the first ground terminal on the basis of the signal terminal on the upper surface of the substrate.

The UWB antenna may further include at least one slot for intercepting current flowing backward to the first and second ground terminal.

In this case, the dipole radiator may include a first pole connected to the signal terminal, a second pole connected to the second ground terminal, and a first slot line for exciting the dipole radiator.

One end of the first slot line may be connected to the power feeding part, the other end of the first slot line may form an input part of the dipole radiator, and a space between the first pole and the second pole may be gradually widened, starting from the input part.

The loop radiator may include an active loop radiator having one end connected to the signal terminal and the other end connected to the first ground terminal, excited by the electromagnetic energy fed through the signal terminal, enhancing the electromagnetic waves radiating in one direction from the dipole radiator, and canceling the electromagnetic fields produced in the other direction from the dipole radiator; and at least one passive loop radiator excited by an induced electromagnetic energy induced by the dipole radiator and the active loop radiator, enhancing the electromagnetic waves radiating in one direction from the dipole radiator, and canceling the electromagnetic fields produced in the other direction from the dipole radiator.

In this case, the active loop radiator may include a second slot line exciting the active loop radiator, and a loop connected to the second slot line and having remaining sides except for a side connected to the second slot line, which are closed sides.

The dipole antenna, the power feeding part and the loop radiator are formed in a manner that a metal layer deposited on the surface of the substrate is patterned in a specified form, and the surface of the substrate that corresponds to an area between the first pole and the second pole, an area between the signal terminal and the first ground terminal, an area between the signal terminal and the second ground terminal, a loop area of the active loop radiator and a loop are of the passive loop radiator is exposed.

The at least one slot may include at least one first slot formed by patterning a specified area of a side metal layer in which the active loop radiator is formed on the basis of the dipole radiator, and at least one second slot formed by patterning a specified area of a side metal layer in which the passive loop radiator is formed on the basis of the dipole radiator.

In the exemplary embodiments of the present invention as described above, the substrate may be produced in the form of a rectangular flat board of which vertical sides are longer than its horizontal sides.

In this case, the power feeding part may be positioned at an edge of the vertical side of the substrate, and the dipole radiator may be arranged in a direction toward the side opposite to the vertical side where the power feeding part is positioned to radiate the electromagnetic waves in the same direction as a feeding direction.

The power feeding part may be positioned at an edge of the horizontal side of the substrate, and the dipole radiator may be arranged in a direction toward the vertical side of the substrate to radiate the electromagnetic waves in a direction perpendicular to a feeding direction.

The substrate may be a rectangular flat board having a horizontal side of 0.2 $\lambda$min and a vertical side of 0.3 $\lambda$min if a minimum frequency in an available frequency band is fmin and a free-space wavelength corresponding to the minimum frequency fmin is $\lambda$min.

The characteristic impedance of the second slot line may be three or four times the characteristic impedance of the first slot line.

The width of the second slot line may be wider than the width of the first slot line to improve the characteristic impedance.

An area of the substrate in which the second slot line is formed may be etched to increase the characteristic impedance of the second slot line.

The difference between an electric length of the first slot line and an electric length of the second slot line in the minimum frequency state may be 0.15 $\lambda$min if a minimum frequency in an available frequency band is fmin and a free-space wavelength corresponding to the minimum frequency fmin is $\lambda$min.

BRIEF DESCRIPTION OF THE DRAWINGS

The above aspects and features of the present invention will become more apparent by describing certain exemplary embodiments of the present invention with reference to the accompanying drawings, in which.

DETAILED DESCRIPTION OF THE EXEMPLARY EMBODIMENTS

Figure 1:
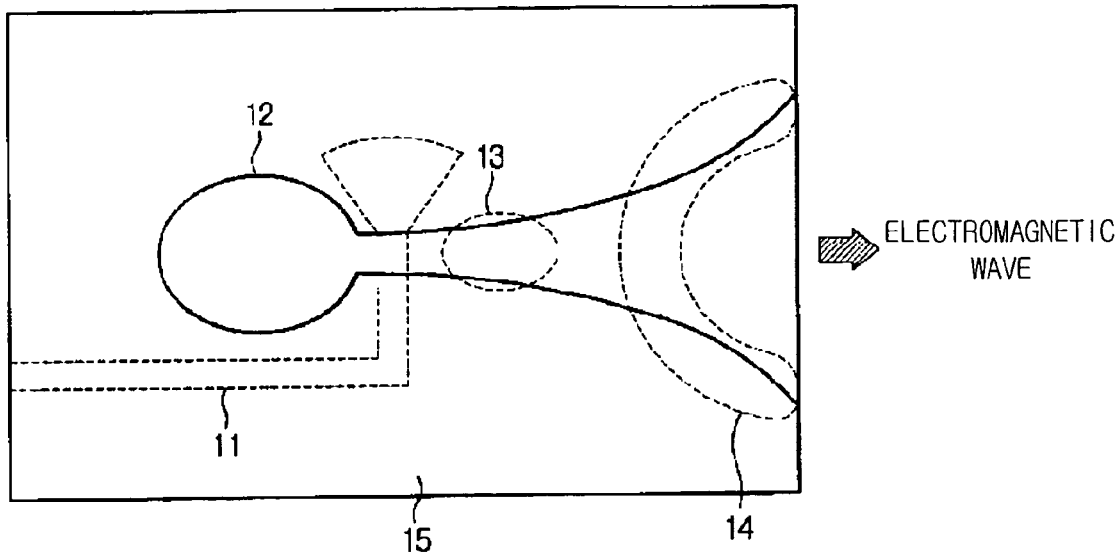
FIG. 1 (PRIOR ART)
FIG. 1 is a view illustrating the structure of a conventional Vivaldi antenna.
Figure 2:
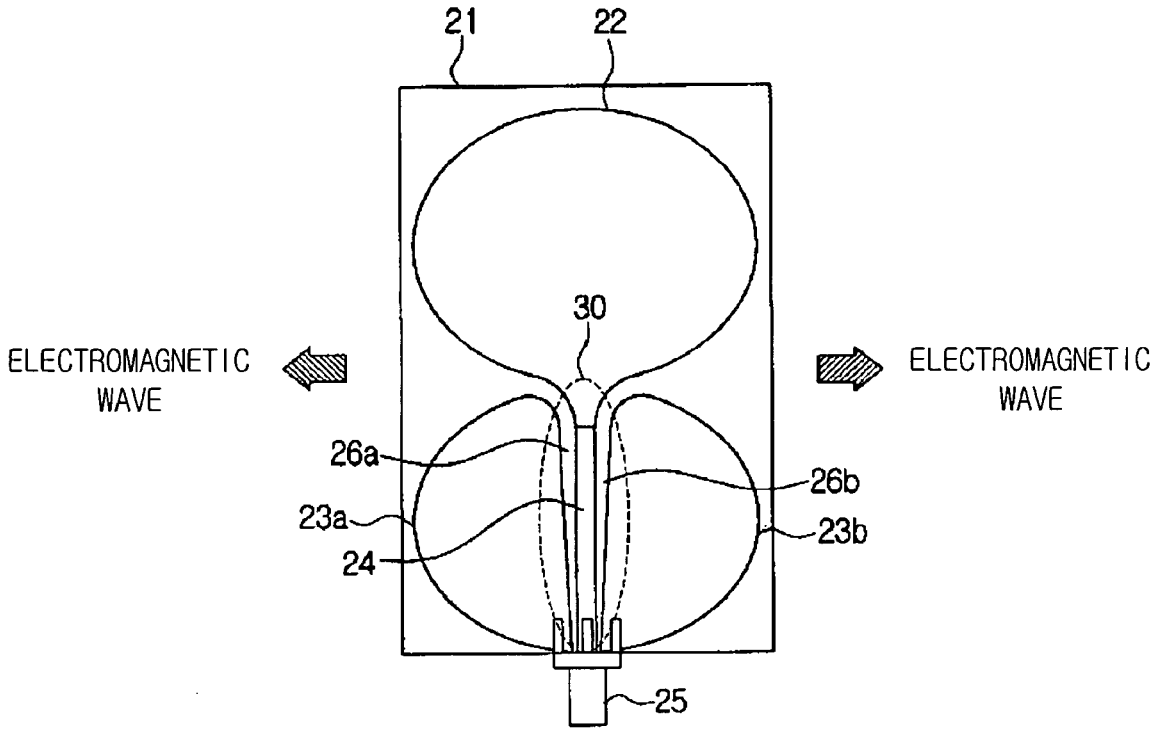
FIG. 2 (PRIOR ART)
FIG. 2 is a view illustrating the structure of a conventional substrate type dipole antenna.

Certain exemplary embodiments of the present invention will be described in greater detail with reference to the accompanying drawings.

In the following description, same drawing reference numerals are used for the same elements even in different drawings. The matters defined in the description such as a detailed construction and elements are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

Figure 3:
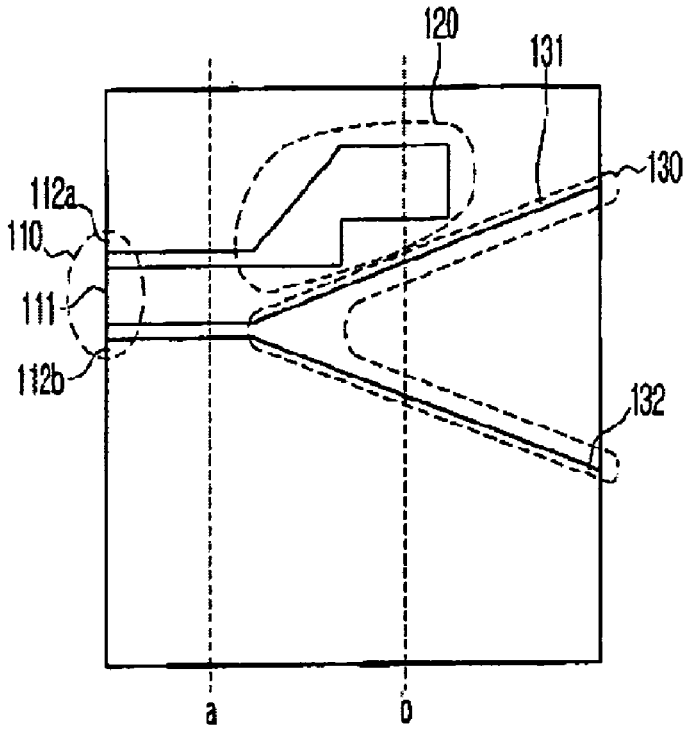
FIG. 3 is a view illustrating the structure of a UWB antennal according to an exemplary embodiment of the present invention.

FIG. 3 is a view illustrating the structure of a UWB antennal according to an exemplary embodiment of the present invention.

Referring to FIG. 3, the UWB antenna according to an exemplary embodiment of the present invention includes a power feeding part 110, an active loop radiator 120, and a dipole radiator 130.

The power feeding part 110 is connected to an external terminal, and transfers electromagnetic energy supplied from the external terminal to the following parts. For this, the power feeding part 110 includes a signal terminal 111 and ground terminals 112*a* and 112*b*. In addition, it is preferable, but not always necessary, that the power feeding part 110 is constructed to have a coplanar waveguide structure in which the ground terminals 112*a* and 112*b* and the signal terminal 111 are positioned on the same plane. This is because the coplanar waveguide structure is useful to the implementation of a monolithic microwave integrated circuit (MMIC) or a micro integrated circuit (MIC). The ground terminals 112*a* and 112*b*, which are now referred to the first ground terminal 112*a* and the second ground terminal 112*b*, are arranged on both sides around the signal terminal 111.

The active loop radiator 120 has one end connected to the signal terminal 111 of the power feeding part 110 and the other end connected to the first ground terminal 112*a*. Accordingly, the electromagnetic energy inputted through the signal terminal 111 is guided in the direction of the first ground terminal 112*a*. Accordingly, an omnidirectional radiation pattern is formed around the UWB antenna.

The dipole radiator 130 is composed of a first pole 131 and a second pole 132. The dipole radiator 130 radiates the electromagnetic waves of the same polarity toward one side and the other side of the UWB antenna. The polarities of electric fields produced by the electromagnetic waves radiated from the dipole radiator 130 are the same at one side and the other side of the substrate. In this case, the electric field formed at one side (e.g., the right side in FIG. 3) of the substrate has the same polarity as that produced by the electromagnetic wave-radiated from the active loop radiator 120, and thus the electric field is enhanced. By contrast, the electric field formed at the other side (e.g., the left side in FIG. 3) of the substrate has a different polarity from that produced by the electromagnetic wave radiated from the active loop radiator 120, and thus the electric field is canceled. As a result, a unidirectional radiation pattern, which corresponds to the electric field produced on only one side of the substrate, is formed.

Figure 4:
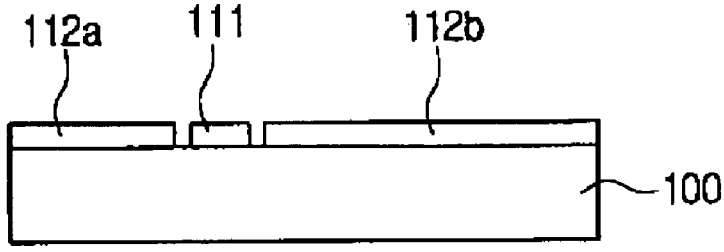
FIGS. 4 and 5 are exemplary sectional views illustrating the antenna of FIG. 3.

FIG. 4 is a sectional view of the UWB antenna of FIG. 3, seen from a point 'a'. Referring to FIG. 4, the UWB antenna is supported by the substrate 100. The signal terminal 111 and the first and second ground terminals 112*a* and 112*b* that constitute the power feeding part 110 are constructed to have the coplanar waveguide structure.

Figure 5:
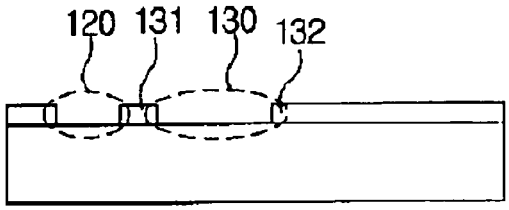

FIG. 5 is a sectional view of the UWB antenna of FIG. 3, seen from a point 'b'. Referring to FIG. 5, the active loop radiator 120 and the dipole radiator 130 are positioned on the same plane as the power feeding part 110 on the upper surface of the substrate 100. In addition, the first pole 131 of the dipole radiator 130 becomes a part of the active loop radiator 120.

The UWB antenna having the structure as illustrated in FIGS. 4 and 5 may be produced by depositing a metal layer on the substrate 100 and patterning the metal layer by etching. That is, the power feeding part 110, the active loop radiator 120 and the dipole radiator 130 can be formed at a time by inputting an etching liquid or etching gas after depositing a photoresist layer patterned as shown in FIG. 3 on the metal layer.

Figure 6:
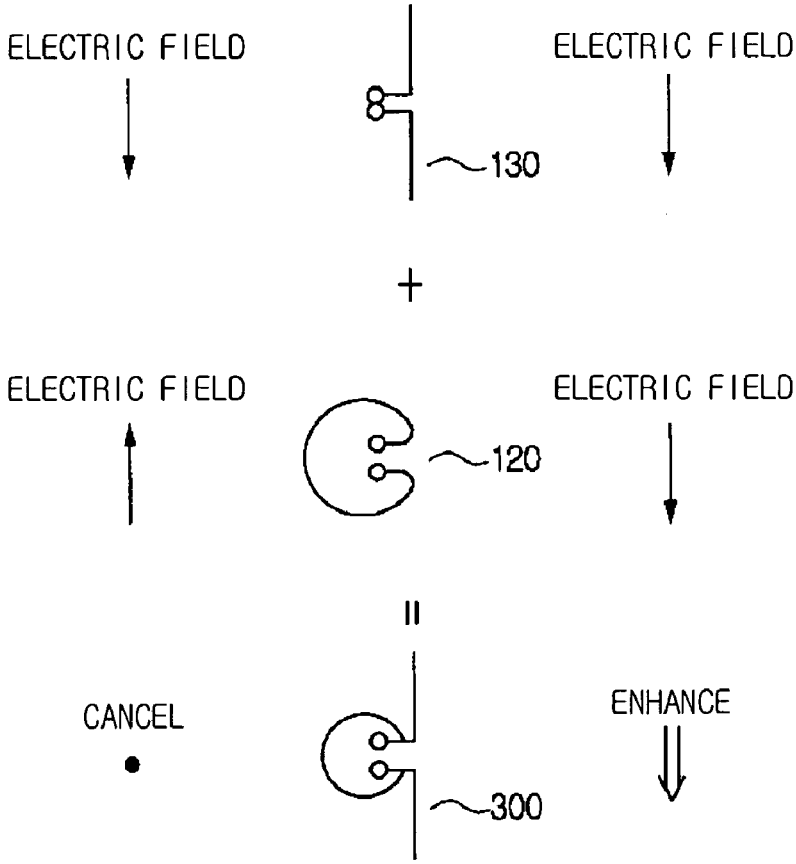
FIG. 6 is a view explaining the principle of the unidirectional radiation pattern that the UWB antenna of FIG. 3 has.

FIG. 6 is a view explaining the principle of the unidirectional radiation pattern that the UWB antenna of FIG. 3 has. FIG. 6 illustrates the polarities of the electric fields produced in a far-field region that is a predetermined distance apart from the UWB antenna. Referring to FIG. 6, the electric fields produced in one and the other directions of the substrate 100 by the dipole radiator 130 are all directed downward. That is, electric fields having the same polarity are produced. By contrast, the electric field produced at one side of the substrate 100 by the active loop radiator 120 is directed downward while the electric field produced at the other side of the substrate 100 is directed upward. That is, electric fields having different polarities are produced.

As a result, if the UWB antenna 300 is implemented by combining the active loop radiator 120 and the dipole radiator 130, the electric field produced at one side of the substrate is enhanced and the electric field produced at the other side is canceled. Accordingly, a unidirectional radiation pattern is formed at one side of the substrate.

Figure 7:
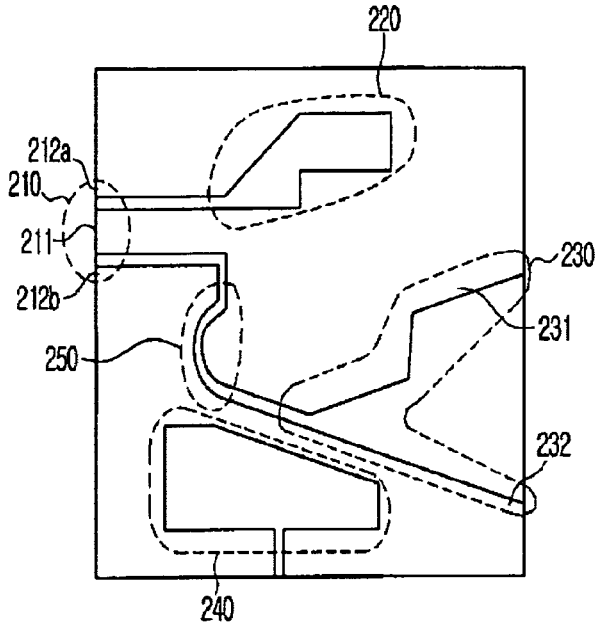
FIGS. 7, 8 and 9 are views illustrating the structure of a UWB antenna according to another exemplary embodiment of the present invention.

FIG. 7 is a view illustrating the structure of a UWB antennal according to another exemplary embodiment of the present invention. Referring to FIG. 7, the UWB antenna further includes a passive loop radiator 240 and a delay part 250 in addition to the power feeding part 210, the active loop radiator 220 and the dipole radiator 230.

The passive loop radiator 240 is formed in a metal layer part connected to the second ground terminal 212*b*. Accordingly, the passive loop radiator cannot receive the electromagnetic energy from the power feeding part 210, but can receive the induced electromagnetic energy induced when the active loop radiator 220 and the dipole radiator 230 are excited. Accordingly, the passive loop radiator 240 also radiates the electromagnetic wave in an omnidirectional radiation pattern. By adjusting the size and position of the passive loop radiator 240, the radiation pattern of the UWB antenna can be optimally adjusted. That is, the electromagnetic field produced by the passive loop radiator 240 enhances and cancels the electromagnetic fields produced in one and the other directions of the substrate by the dipole radiator 230. In FIG. 7, only one passive loop radiator 240 is illustrated. However, a plurality of passive loop radiators may be implemented according to exemplary embodiments of the present invention.

On the other hand, the first pole 231 that constitutes the dipole radiator 230 is connected to the signal terminal 211, and the second pole 232 is connected to the second ground terminal 212*b*. In this case, the region where the first pole 231 and the second pole 232 are branched is a predetermined distance apart from the power feeding part 210 to form a delay part 250. Accordingly, the delay part 250 serves to delay the time point of supplying the electromagnetic energy being supplied to the dipole radiator 230. As a result, by matching the phase of the electromagnetic field produced by the active and passive loop radiators 220 and 240 to the phase of the electromagnetic field produced by the dipole radiator 230, the electromagnetic field enhancement and cancellation can be performed.

Figure 8:
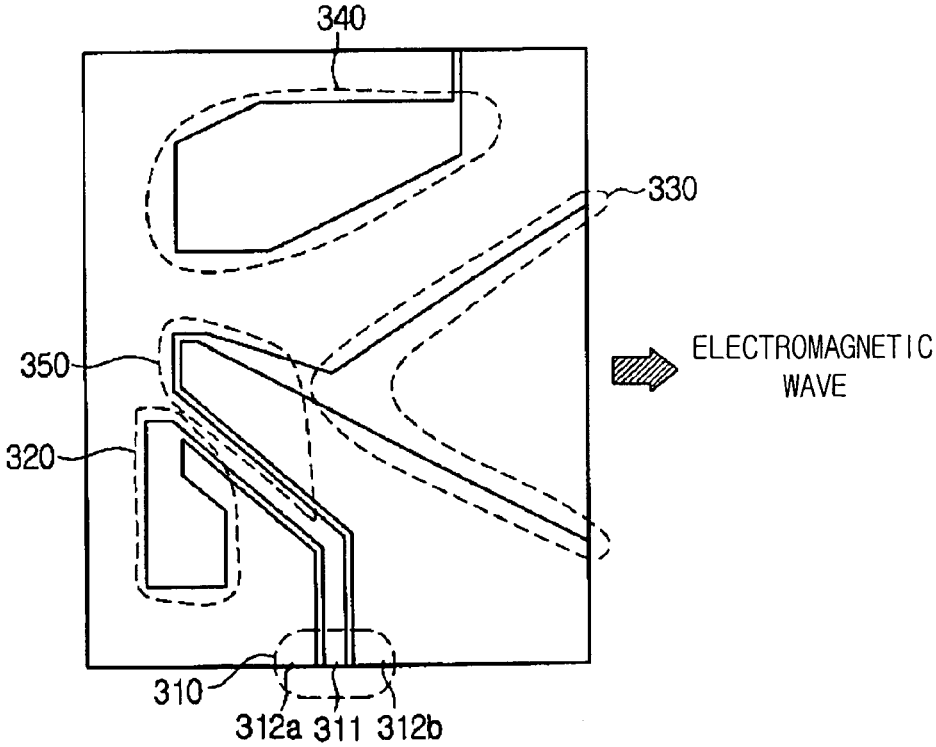

FIG. 8 is a view illustrating the structure of a UWB antennal according to still another exemplary embodiment of the present invention. According to the UWB antenna of FIG. 8, the shapes and positions of a power feeding part 310, an active loop radiator 320, a dipole radiator 330, a passive loop radiator 340 and a delay part 350 are different from those of the UWB antenna of FIG. 7. By changing the pattern of the metal layer, the UWB antenna can be produced to have the structure as illustrated in FIG. 8. Referring to FIG. 8, the passive loop radiator 340 is not connected to the second ground terminal 312*b* of the power feeding part 310, but is formed on the side of the first ground terminal 312*a*. The passive loop radiator 340 is formed on an upper part of the dipole radiator 330. Since the operation of the UWB antenna of FIG. 8 is the same as that of the UWB antenna of FIG. 7, further explanation thereof will be omitted.

Figure 9:
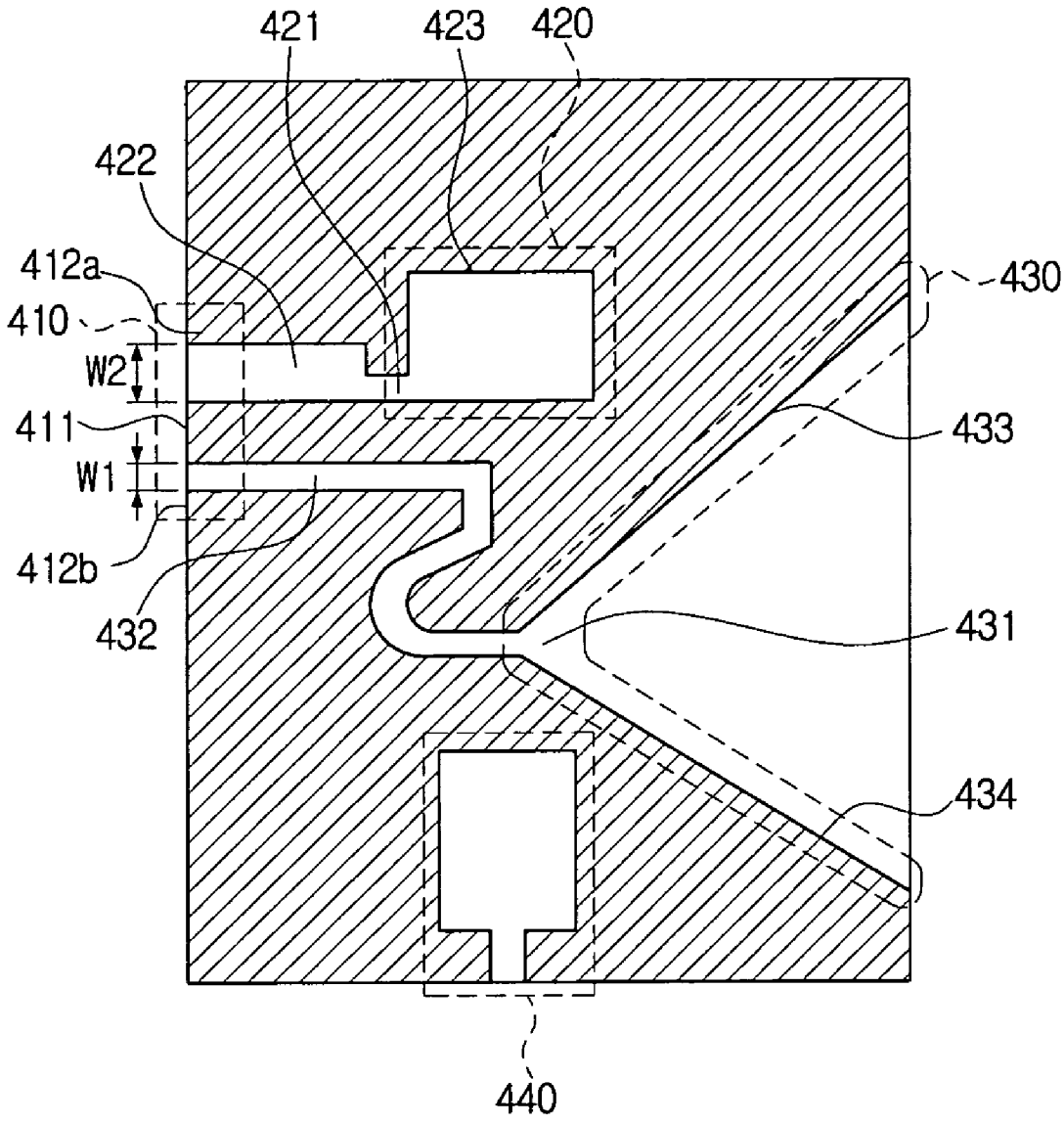

FIG. 9 is a view illustrating the structure of a UWB antenna according to still another exemplary embodiment of the present invention. The UWB antenna of FIG. 9 includes a power feeding part 410, an active loop radiator 420, a dipole radiator 430, and a passive loop radiator 440. The respective constituent elements may be formed by patterning the metal layer deposited on the substrate. That is, parts except for parts marked with slanting lines in FIG. 9 represent the upper surface of the substrate. Accordingly, the respective constituent elements in FIG. 9 are separately formed on the metal layer of the first pole side 433 of the dipole radiator 430 and on the metal layer of the second pole side 434 of the dipole radiator 430. Referring to FIG. 9, the active loop radiator 420 is formed on the metal layer of the first pole side 433, and the passive loop radiator 440 is formed on the metal layer of the second pole side 434.

The power feeding part 410 includes a signal terminal 411, a first ground terminal 412*a* and a second ground terminal 412*b*. Although not illustrated in FIG. 9, the power feeding part 410 is provided with a connector in which a power feeding cable can be mounted. In FIG. 9, parts indicated as the signal terminal 411, the first ground terminal 412*a* and the second ground terminal 412*b* mean parts connected to the signal line and ground lines of the connector.

On the other hand, a space between the signal terminal 411 and the second ground terminal 412*b* and a space between the first pole 433 and the second pole 434 form a first slot line 432. The first slot line 432 excites the dipole radiator 430 during a power feeding. One end of the first slot line 432 is connected to the power feeding part 410, and the other end thereof is connected to an input part 431. The first pole 433 and the second pole 434 branch out so that a space between them is gradually widened, starting from the input part 431. The direction in that the first pole 433 and the second pole 434 branch out is the same as the direction toward the side opposite to the side in which the power feeding part 410 is located, i.e., the direction in which the power feeding is performed.

A specified part of the first slot line 432, i.e., a part bent in a direction toward the input part 431 in FIG. 9, may operate as delay parts 250 and 350 provided in the UWB antennas of FIGS. 7 and 8.

On the other hand, the active loop antenna 420 includes a second slot line 422 and a loop 423. The second slot line 422 means a space between the signal terminal 411 and the first ground terminal 412*a*. The second slot line 422 excites the active loop antenna 420. One end of the second slot line 422 is connected to the power feeding part 410. The loop 423 has the remaining sides except for the side connected to the second slot line 422, which are closed sides. The connection part of the second slot line 422 and the loop 423 form the input part 421 of the active loop antenna. That is, the other end of the second slot line 422 forms the input part 421 of the active loop antenna.

The width w1 of the first slot line 432 and the width w2 of the second slot line 422 are in proportion to the characteristic impedance of the first and second slot lines 432 and 422. That is, as the width of the slot line is widened, the value of the characteristic impedance is increased. Using this characteristic, the antenna characteristic can be optimized by adjusting the characteristic impedance ratio of the first and second slot lines 432 and 422. Specifically, the widths of the first and second slot lines may be determined so that the characteristic impedance of the second slot line 422 becomes three or four times the characteristic of the first slot line 432.

In order to improve the characteristic impedance of the second slot line 422, the width w2 may be widened. In this case, if the width w2 is increased too much, the second ground terminal 412*a* may escape from the range of the power feeding part 410, i.e., the part to which the connector is connected. Thus, the characteristic impedance can be improved by widening the sectional area of the second slot line 422 through the etching of the substrate area that corresponds to the second slot line 422 in a state where the width w2 is maintained.

The substrate used in the UWB antenna of FIG. 9 may be implemented by a dielectric substrate in the form of a rectangular flat board. The lengths of the horizontal and vertical sides of the dielectric substrate may be optionally set according to the use field and purpose of the UWB antenna.

Specifically, if the minimum frequency in an available frequency band is fmin and a free-space wavelength corresponding to the minimum frequency fmin is $\lambda$min, the length of the horizontal side of the substrate may be set to 0.2 $\lambda$min and the length of the vertical side thereof may be set to 0.3 $\lambda$min. Also, as illustrated in FIG. 9, if the power feeding part 410 is arranged at the end of the left vertical side and the first and second poles 433 and 434 of the dipole radiator 430 are arranged so that they are widened in a direction opposite to the position of the power feeding part 410 (e.g., to the right in the drawing), the passive loop radiator 440 is provided on the metal layer opposite to the active loop antenna 420. It is preferable, but not always necessary, that the passive loop radiator 440 is formed at a position of the horizontal side of the substrate that is apart for about 0.05 to 0.067 λmin from the vertical side of the substrate where the power feeding part 410 is located.

It is preferable, but not always necessary, that the difference between the electric length of the first slot line 432 and the electric length of the second slot line 422 in the minimum frequency condition is set to about 0.15 λmin. For example, if the minimum frequency fmin is 3.2 GHz, the wavelength λmin corresponding to the minimum frequency fmin on a dielectric material is about 3.2 cm. Accordingly, the length difference between the first and second slot lines 432 and 422 is about 5 mm.

Figure 10:
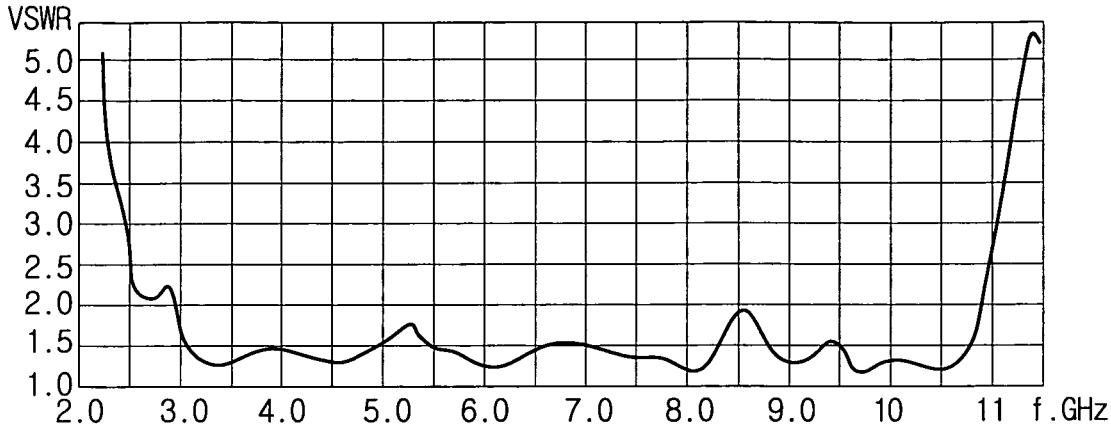
FIG. 10 is a graph explaining the voltage standing wave ratio (VSWR) characteristic of a UWB antenna of FIG. 9.

FIG. 10 is a graph explaining the voltage standing wave ratio (VSWR) characteristic of a UWB antenna of FIG. 9. In FIG. 10, the horizontal axis represents a frequency f[GHz], and the vertical axis represents a VSWR. If the VSWR value is less than 2, electromagnetic waves corresponding to 90% or more of the input power can be radiated. According to the graph of FIG. 10, the UWB antenna of FIG. 9 can be used in the frequency band of about 2.9 to 10.8 GHz, and thus the UWB communication becomes possible.

Figure 11:
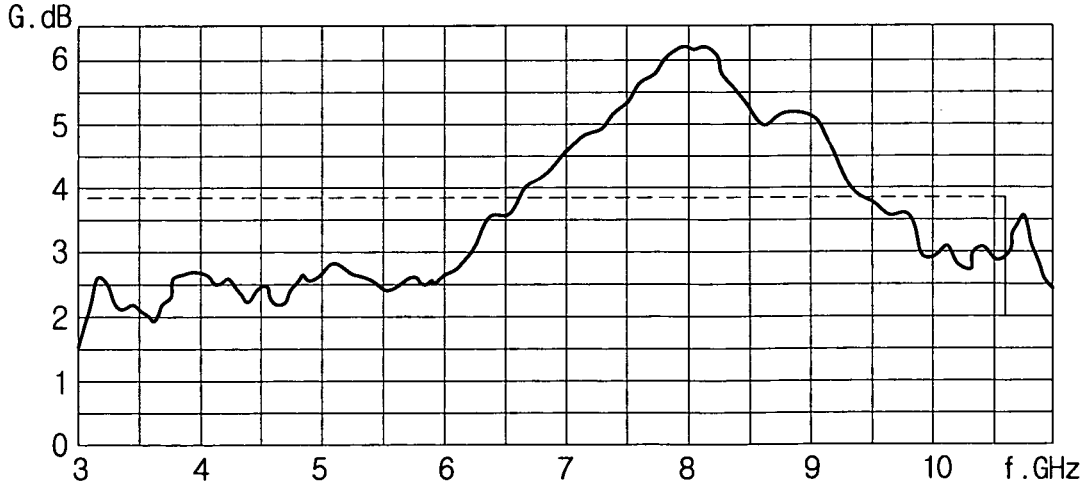
FIG. 11 is a graph explaining the antenna gain characteristic of a UWB antenna of FIG. 9.

FIG. 11 is a graph explaining the antenna gain characteristic of a UWB antenna of FIG. 9. In FIG. 11, the horizontal axis represents a frequency f[GHz], and the vertical axis represents a gain G[dB]. According to the graph of FIG. 11, an average gain in the frequency band of 3 to 10.5 GHz appears high, e.g., about 3.8 dBi. In particular, an average gain in the frequency range of 6.5 to 9.5 GHz appears more than 4 dBi. A high antenna gain means a distinct directionality of the radiation pattern. That is, according to the gain characteristic of FIG. 11, it can be recognized that the UWB antenna has a unidirectional radiation pattern whereby stronger electromagnetic waves are radiated in a specified direction.

Figure 12:
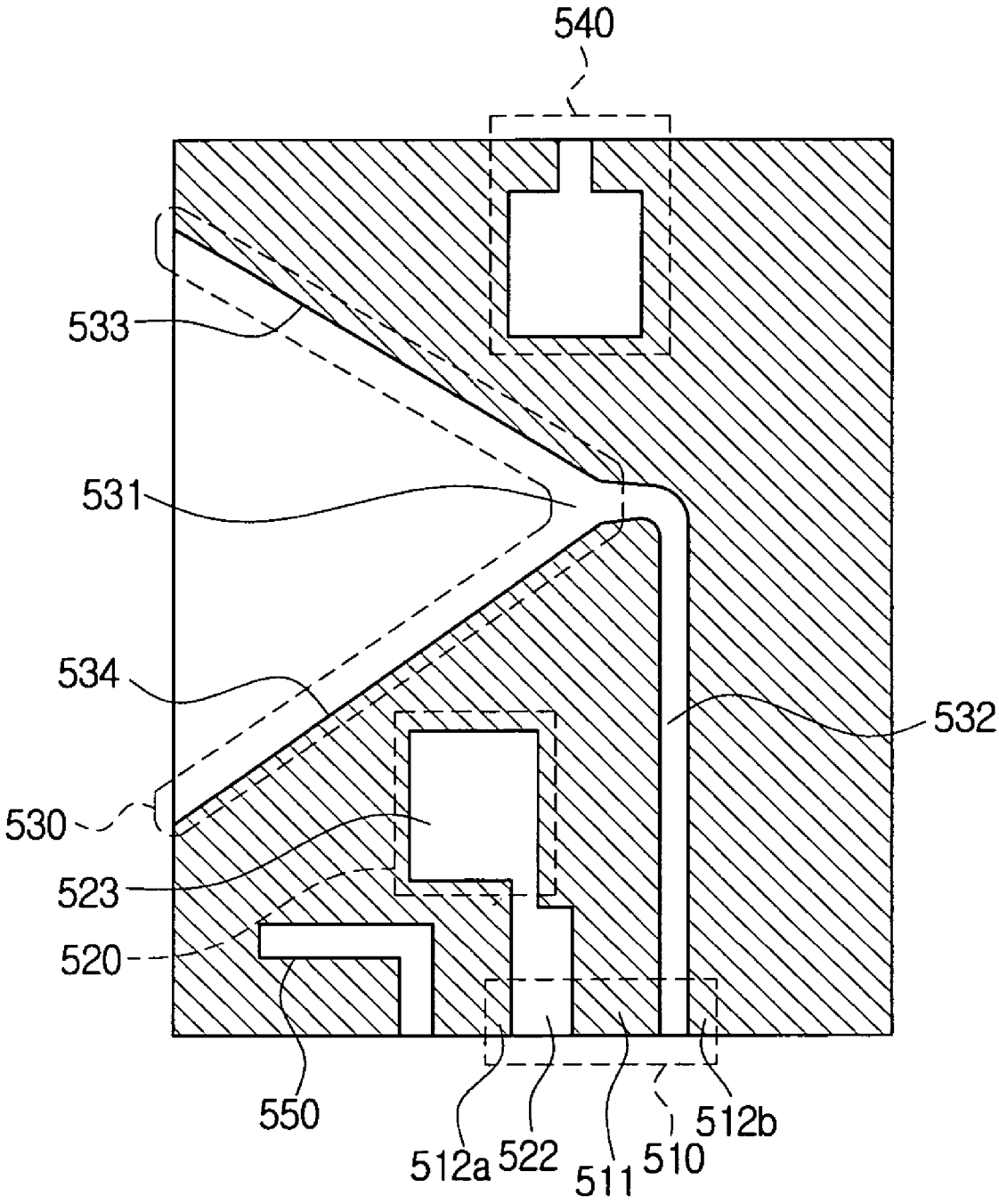
FIGS. 12 and 13 are views illustrating the structure of a UWB antenna with a slot added thereto according to still another exemplary embodiment of the present invention.

FIG. 12 is a view illustrating the structure of a UWB antenna with a slot added thereto according to still another exemplary embodiment of the present invention. The UWB antenna of FIG. 12 is provided with a slot 550 in addition to a power feeding part 510, an active loop radiator 520, a dipole radiator 530 and a passive loop radiator 540.

According to the UWB antenna of FIG. 12, the power feeding part 510 is arranged at the end of the horizontal side of the substrate, and the dipole radiator 530 is arranged toward the left. Accordingly, the main radiation direction of the electromagnetic waves is perpendicular to the feeding direction. Although the UWB antenna of FIG. 8 is formed so that the radiation direction is perpendicular to the feeding direction, the radiation direction of the UWB antenna of FIG. 12 is opposite to the radiation direction of the UWB antenna of FIG. 8.

The active loop radiator 520 and the passive loop radiator 540 on both sides of the metal layer are formed on the substrate around the dipole radiator 530. One end of the active loop radiator 520 is connected to the signal terminal 511 in the power feeding part 510, and the other end thereof is connected to the first ground terminal 512*a* in the power feeding part 510. In this case, current flowing along the active loop radiator 520 may flow backward to the first ground terminal 512*a* as a leak current. This leak current may cause the radiation pattern to lean to the power feeding cable.

Accordingly, by forming the slot 550 around the active loop radiator 520 as shown in FIG. 12, the backward flow of the current, which flows into the signal terminal 511 and along the metal layer at the end of the substrate, to the first ground terminal 512*a* can be intercepted in advance, and thus the current leakage can be prevented.

The construction and operation of first and second poles 533 and 534 constituting the dipole radiator 530, an input part 531, a first slot line 532, a second slot line 522 constituting the active loop radiator 520, a loop 523, and the passive loop radiator 540 are the same as those of the exemplary embodiments as described above, the duplicated explanation thereof will be omitted.

Figure 13:
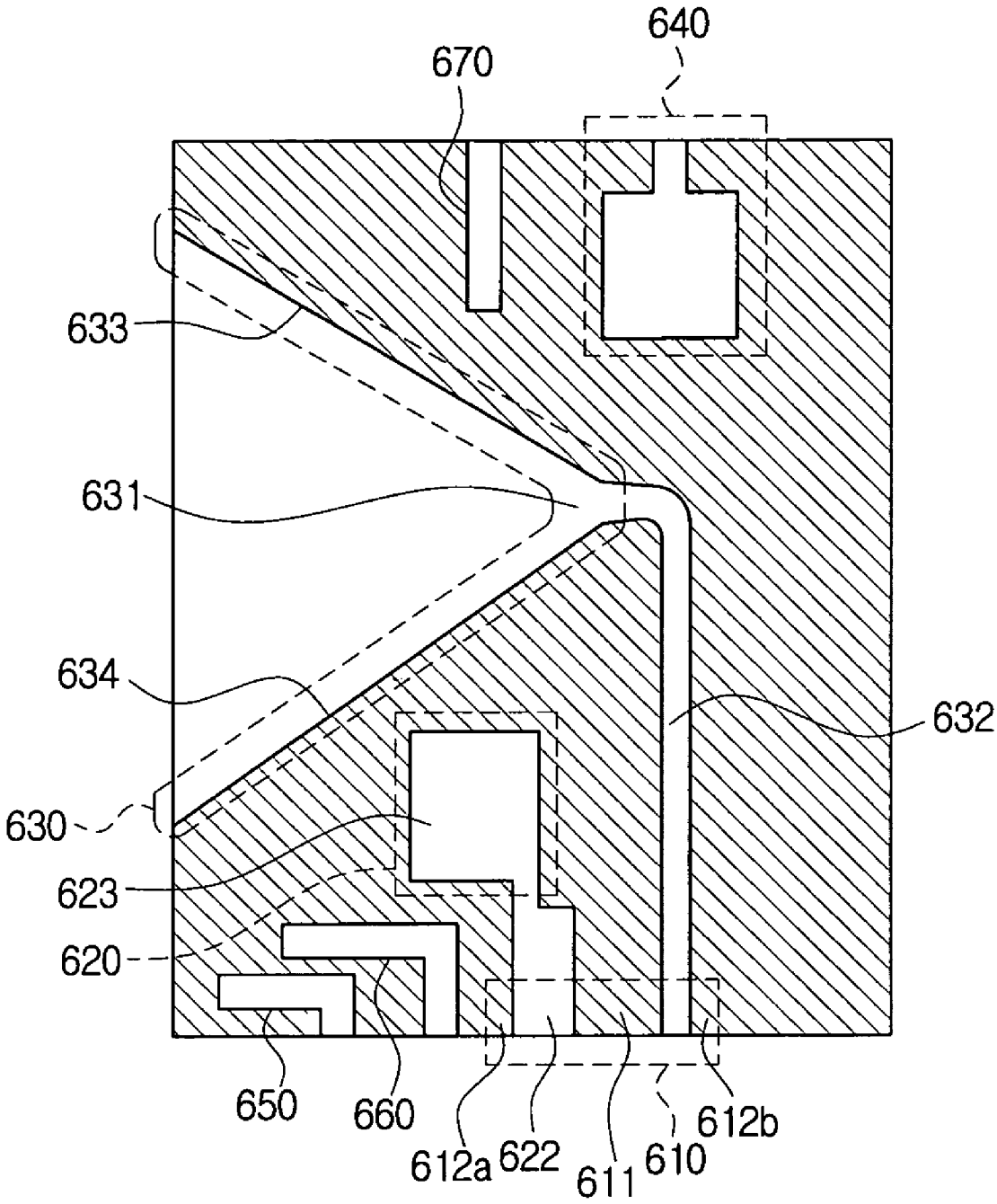

FIG. 13 is a view illustrating the structure of a UWB antenna with slots added thereto according to still another exemplary embodiment of the present invention. The UWB antenna of FIG. 13 is provided with a plurality of slots 650, 660 and 670 in addition to a power feeding part 610, an active loop radiator 620, a dipole radiator 630 and a passive loop radiator 640.

Specifically, two slots 650 and 660 are formed around the active loop radiator 620, and one slot 670 is formed around the passive loop radiator 640. In the following description, the slots 650 and 660 around the active loop radiator 620 are called first slots, and the slot 670 around the passive loop radiator 640 is called a second slot. The number and length of the first and second slots 650, 660 and 670 may be optionally adjusted.

Preferably, but not necessarily, the electric lengths of the slots 650, 660 and 670 may be set in the range of 0.2 λmin to 0.25 λmin.

The construction and operation of first and second poles 633 and 634 constituting the dipole radiator 630, an input part 631, a first slot line 632, a second slot line 622 constituting the active loop radiator 620, a loop 623, and the passive loop radiator 640 are the same as those of the exemplary embodiments as described above, the duplicated explanation thereof will be omitted.

Figure 14:
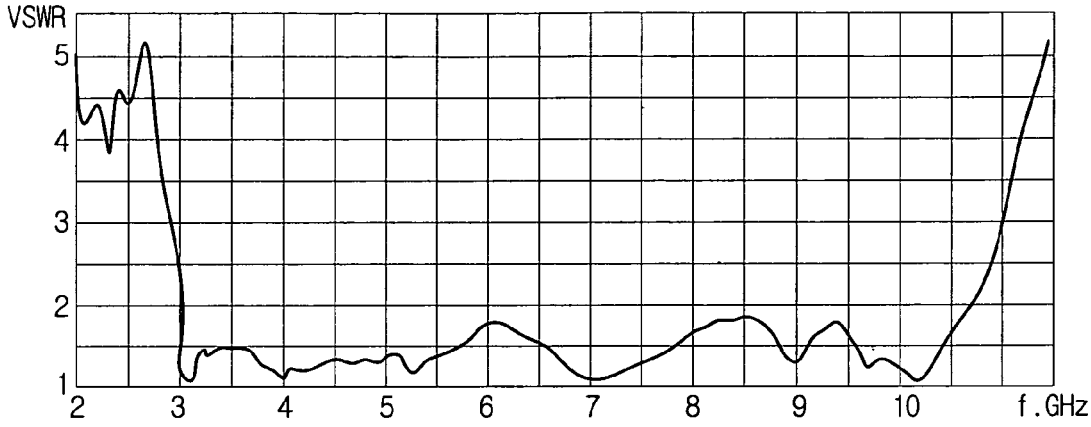
FIG. 14 is a graph explaining the voltage standing wave ratio (VSWR) characteristic of a UWB antenna of FIG. 13.
Figure 15:
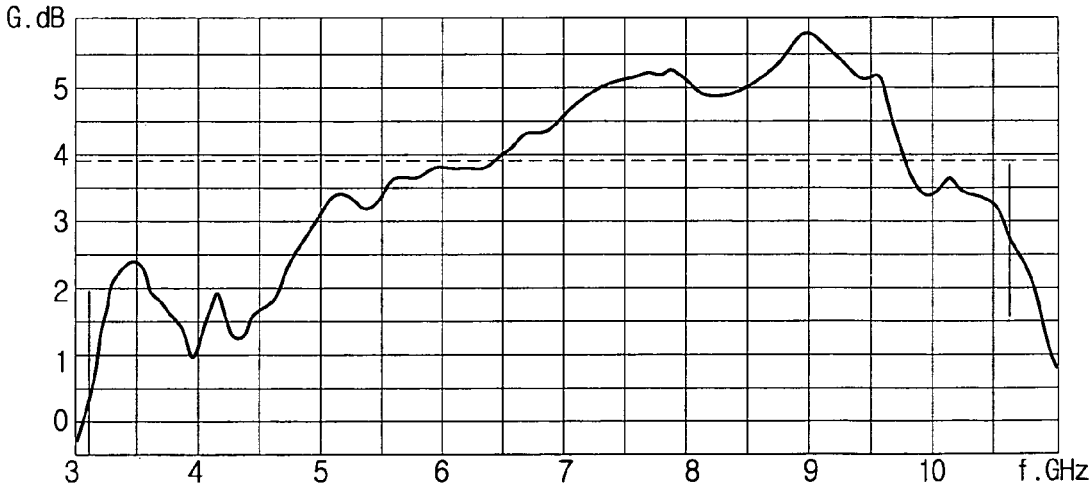
FIG. 15 is a graph explaining the antenna gain characteristic of a UWB antenna of FIG. 13.

FIGS. 14 and 15 are graphs illustrating the measured characteristics of the UWB antenna of FIG. 13. In FIGS. 14 and 15, experimental results of a UWB antenna are illustrated, in which the lengths of horizontal and vertical sides and thickness of the substrate are set to 20 mm, 30 mm and 1.27 mm, respectively, the difference between the electric length of the first slot line 632 and the electric length of the second slot line 622 is set to about 0.15 λmin, and the electric lengths of the respective slots are set in the range of 0.2 λmin to 0.25 λmin.

FIG. 14 shows a graph representing the VSWR characteristic of the UWB antenna of FIG. 13. Referring to FIG. 14, VSWR appears less than 2 in the frequency band of 3.0 to 10.7 GHz. Accordingly, it can be recognized that the antenna of FIG. 13 can be used in the UWB frequency band.

FIG. 15 shows a graph representing the antenna gain characteristic of the UWB antenna of FIG. 13. Referring to FIG. 15, an average gain appears about 3.8 dBi in the frequency band of 3.0 to 10.7 GHz. Accordingly, it can be recognized that the UWB antenna of FIG. 13 has a unidirectional radiation pattern.

As exemplary embodiments of the present invention, a UWB antenna may be produced by combination of the active loop radiators 120, 220, 320, 420, 520 and 620 and the dipole radiators 130, 230, 330, 430, 530 and 630. The frequency characteristics of the respective radiators are as follows. The dipole radiators 130, 230, 330, 430, 530 and 630 operate like capacitors in a low frequency band, and if the frequency exceeds a specified frequency f1, they radiate the electromagnetic waves. That is, they operate as antennas only in a frequency band that exceeds f1. By contrast, the active loop radiators 120, 220, 320, 420, 520 and 620 operate like inductors, and if the frequency exceeds a specified frequency f2, they radiate the electromagnetic waves. According to the exemplary embodiments of the present invention, the dipole radiators 130, 230, 330, 430, 530 and 630 and the active loop radiators 120, 220, 320, 420, 520 and 620 are combined, and then the size of at least one of them is adjusted so that the threshold frequencies coincide with each other (i.e., f1=f2). Accordingly, in the frequency range of f<f1=f2, the capacitance components of the dipole radiators 130, 230, 330, 430, 530 and 630 and the inductance components of the active loop radiators 120, 220, 320, 420, 520 and 620 are canceled each other. Thus, even in the frequency range of f<f1=f2, the electromagnetic waves are radiated. In this case, by additionally providing the passive loop radiators 240, 340, 440, 540 and 640 as illustrated in FIGS. 7, 8, 9, 12 and 13, the radiation characteristics can be tuned. Also, as illustrated in FIGS. 12 and 13, by additionally providing the slots 550, 650, 660 and 670, the UWB antenna can be designed whereby the radiation pattern is not distorted.

As a result, since the antenna can operate in a low frequency band although the size of the antenna is not increased, the UWB communication becomes possible. Accordingly, if the UWB antenna according to the present invention is used, a gain improved as much as 3 dB at maximum can be obtained in comparison to that of the conventional UWB antenna having a similar size.

As described above, the antenna according to exemplary embodiments of the present invention has a unidirectional radiation pattern, makes a UWB communication possible, and can be miniaturized. Accordingly, the antenna according to exemplary embodiments of the present invention can be applied to various kinds of portable communication appliances being presently developed. In addition, since the antenna according to exemplary embodiments of the present invention can be produced by depositing a single metal layer on the substrate and then patterning the metal layer, its production process is simplified. In particular, the antenna according to the present invention has an improved antenna gain in comparison to the conventional UWB antenna having the same size. In addition, by adding at least one slot, the current leakage is prevented, and thus the distortion of the radiation pattern can also be prevented.

The foregoing embodiments and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. An ultra wideband (UWB) antenna comprising:

a substrate;

a power feeding part which is provided on a surface of the substrate and receives an external electromagnetic energy;

a dipole radiator which is excited by the electromagnetic energy fed through the power feeding part and radiates electromagnetic waves;

an active loop radiator which makes the electromagnetic waves radiated by the dipole radiator have a unidirectional radiation pattern by interfering the electromagnetic waves, and at least one passive loop radiator which is excited by the electromagnetic energy induced by the dipole radiator and the active loop radiator, and radiates the electromagnetic energy in an omnidirectional pattern, wherein the power feeding part comprises:

a signal terminal which is provided on the surface of the substrate and receives the electromagnetic energy; and first and second ground terminals arranged on one and the other sides of the signal terminal, respectively, to form a coplanar waveguide structure on the surface of the substrate.

* * * * *